United States Patent [19]

Olive

[11] 3,967,324

[45] July 6, 1976

[54] FLEXIBLE TRAP FOR A WASTE LINE ASSEMBLY

[75] Inventor: Ernest Gene Olive, Maspeth, N.Y.

[73] Assignee: Lawrence Peska Associates, Inc., New York, N.Y. ; a part interest

[22] Filed: May 2, 1975

[21] Appl. No.: 574,014

[52] U.S. Cl. ..... 4/207; 4/DIG. 16; 137/249.41; 285/157

[51] Int. Cl.[2] ..... E03C 1/00

[58] Field of Search ..... 4/DIG. 16, 207; 137/247.41; 285/157

[56] References Cited

UNITED STATES PATENTS 3,470,900 10/1969 Rothauser ..... 285/157

3,860,978 1/1975 Wirth ..... 4/207

*Primary Examiner*—Robert I. Smith

*Attorney, Agent, or Firm*—Richard E. Nanfeldt

[57] ABSTRACT

A flexible trap for a waste line assembly of a toilet includes a U-shaped portion having a pair of upwardly extending legs and a lower section having a threaded hole therethrough. A threaded plug threadably engages the threaded hole. A linear portion having a flexible corrugated section therein is affixed perpendicularly in a fluid serial connection to an upper end of a leg of the U-shaped portion. The U-shaped portion and the linear portion have a continuous bore therethrough.

3 Claims, 2 Drawing Figures

FLEXIBLE TRAP FOR A WASTE LINE ASSEMBLY

SUMMARY OF THE INVENTION

My present invention relates to a unique and novel flexible trap for use in a waste line assembly of a toilet, sink, wash tub, bathtub or basin.

A number of U.S. Pat. Nos. 2,759,765; 3,151,894; and 3,680,896 have employed variously designed flexible pipe members, but these aforementioned patents are non-applicable to my present invention.

An object of my present invention is to provide a flexible trap of simple design and relatively low manufacturing cost for use in a waste line assembly of a toilet, wherein the U-shaped portion of the flexible trap can be moved horizontally and vertically relative to the waste line allowing easier installation of the flexible trap.

Briefly, my present invention comprises a U-shaped portion having a pair of upwardly extending legs and a lower section having a threaded hole therethrough. A threaded plug threadably engages the threaded hole. A linear portion having a corrugated section therein is affixed perpendicularly in a fluid serial connection to an upper end of one of the legs of the U-shaped portion. The U-shaped portion and the linear portion have a continuous bore therethrough.

BRIEF DESCRIPTION OF THE DRAWINGS

The objects and features of the invention may be understood with reference to the following detailed description of an illustrative embodiment of the invention, taken together with the accompanying drawings in which.

DESCRIPTION OF THE PREFERRED EMBODIMENT

Turning now descriptively to the drawings in which similar elements throughout the several views.

Figure 1:
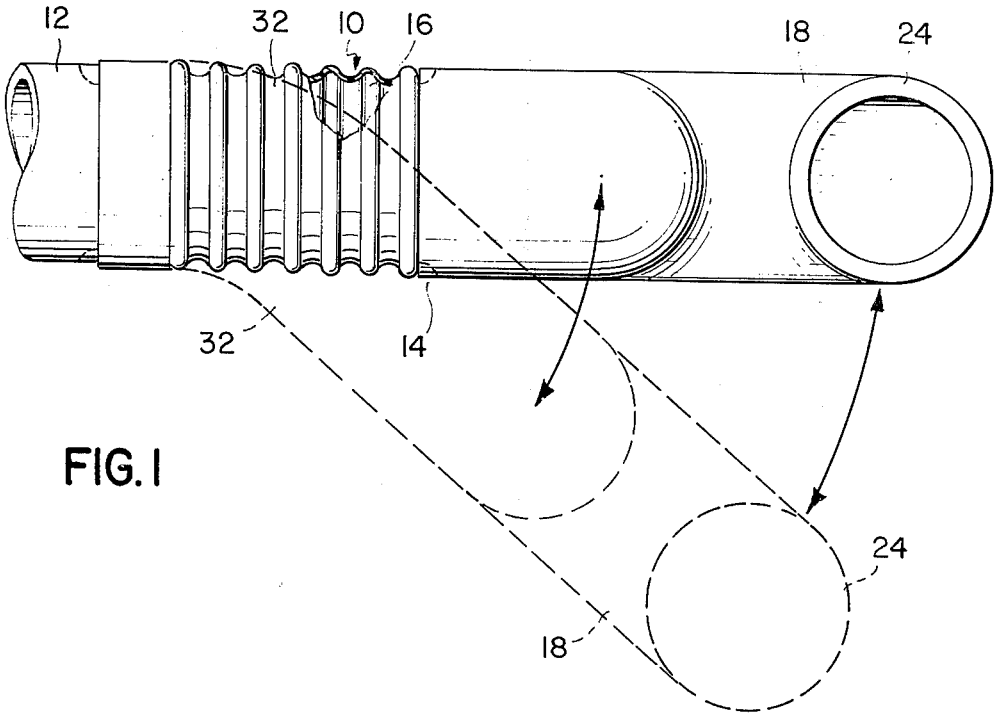
FIG. 1 illustrates a top view of a flexible trap for a waste line of a toilet.
Figure 2:
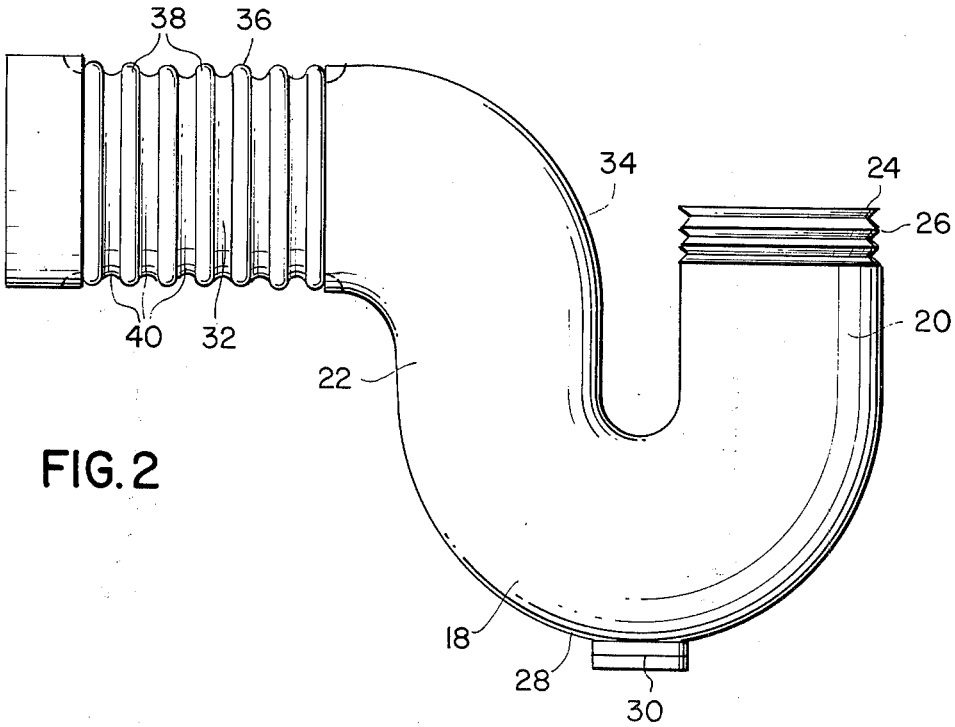
FIG. 2 illustrates a side view of the flexible trap.

FIGS. 1, 2 show a flexible trap 10 adapted to be received into a waste line 12 of a toilet, sink, basin, bathtub or wash tub. The flexible trap 10 comprises a tubular member 14 of a generally circular cross sectional area having a continuous bore 16 therethrough. Member 14 is formed from a U-shaped portion 18 having a pair of upwardly extending legs 20, 22. An upper end 24 of one leg 20 has a threaded outer surface 26. The lower section 28 of the U-shaped portion 18 has a threaded hole (not shown) therethrough, wherein a threaded plug member 30 threadably engages the threaded hole. A linear portion 32 is affixed perpendicularly in a fluid serial connection to an upper end 34 of the other leg 22, wherein the union of leg 22 and portion 32 is a generally curved continuum. The length of leg 22 to the point of the union is greater than the length of leg 20. The U-shaped portion 18 and linear portion 32 are formed as one continuous piece.

The free end 34 of the linear portion 32 has a corrugated section 34 therein. The inside circumferential periphery (not shown) of the free end 34 is threaded so as to receive a waste line 12. The corrugated section 36 consists of a plurality of alternate annular ribs 38 and annular channels 40. The corrugated section 36 allows the U-shaped portion 18 to be moved vertically up and down or horizontally side to side or a combination of horizontal and vertical movement relative to the fixed free end 34 of linear portion 32, as shown by phantom lines 35, whereby the vertical and horizontal movement of the U-shaped portion 18 permits easy installation of the flexible trap 10 into a waste line assembly of a toilet.

The flexible trap can be formed from a metallic substance or a thermoplastic substance selected from the group consisting of polyvinyl chloride, nylon, polyethylene, polypropylene, and polystyrene.

Since obvious changes may be made in the specific embodiment of the invention described herein, such modifications being within the spirit and scope of the invention claimed, it is indicated that all matter contained herein is intended as an illustrative and not as limiting in scope.

Having thus described the invention, what I claim as new and desire to secure by Letters Patent of the United States is:

1. A one piece flexible trap adapted to be received in a waste line assembly which comprises:

a. a U-shaped portion having a pair of upwardly extending legs, a lower section having a threaded hole therethrough, one said leg being longer than other said leg, an upper end of one said leg having a threaded outer surface;

b. a linear portion having a corrugated section therein, one end of said linear portion joined in a smooth curved continimum to an upper end of said other leg of said U-shaped portion, said U-shaped portion and linear portion having a continuous bore therethrough, said corrugation section including a plurality of alternate annular ribs and channels; and c. a threaded plug member threadably engaging into said threaded hole.

2. A flexible trap as recited in claim 1, wherein said trap is metallic.

3. A flexible trap as recited in claim 1, wherein said trap is a thermoplastic.

* * * * *